US008381927B2

(12) United States Patent
Nam

(10) Patent No.: US 8,381,927 B2
(45) Date of Patent: Feb. 26, 2013

(54) CONTAINER

(76) Inventor: Sang Woo Nam, Seoul (KR)

( * ) Notice: Subject to any disclaimer, the term of this patent is extended or adjusted under 35 U.S.C. 154(b) by 113 days.

(21) Appl. No.: 13/044,780

(22) Filed: Mar. 10, 2011

(65) Prior Publication Data

US 2012/0061387 A1 Mar. 15, 2012

(30) Foreign Application Priority Data

Mar. 12, 2010 (KR) ..... 10-2010-0022184

(51) Int. Cl.
*B65D 88/00* (2006.01)
*E05F 1/10* (2006.01)

(52) U.S. Cl. ..... 220/1.5; 220/254.6; 160/188; 160/213; 16/78

(58) Field of Classification Search ..... 220/254.6, 220/254.3, 254.1, 826, 810, 1.5, 1.52; 16/71, 16/78, DIG. 10, DIG. 20; 160/199, 206, 160/210, 213
See application file for complete search history.

(56) References Cited

U.S. PATENT DOCUMENTS

| | | | | | |
|---|---|---|---|---|---|
| 2,765,189 | A * | 10/1956 | Forssell | 292/340 |
| 4,268,084 | A * | 5/1981 | Peters | 296/148 |
| 4,363,351 | A * | 12/1982 | Eriksen | 160/187 |
| 4,601,446 | A | 7/1986 | Opsahl | |
| 5,050,916 | A * | 9/1991 | Pastva | 292/217 |
| 5,920,956 | A * | 7/1999 | Salice | 16/87 R |
| 6,079,762 | A * | 6/2000 | Strasser | 296/36 |
| 6,149,340 | A * | 11/2000 | Pateman | 404/10 |
| 2005/0241781 | A1 * | 11/2005 | Johnson | 160/199 |
| 2006/0207056 | A1 * | 9/2006 | Wang | 16/78 |

FOREIGN PATENT DOCUMENTS

| | | | |
|---|---|---|---|
| DE | 10353885 | A1 | 6/2005 |
| EP | 0077637 | A1 | 4/1983 |
| JP | 2004-001768 | | 1/2004 |
| KR | 1020060101617 | A | 9/2006 |
| WO | 2010/002131 | A2 | 1/2010 |

* cited by examiner

*Primary Examiner* — J. Gregory Pickett
*Assistant Examiner* — Ernesto Grano
(74) *Attorney, Agent, or Firm* — Carter, DeLuca, Farrell & Schmidt LLP

(57) ABSTRACT

A container is provided, which includes a container main body having a loading space formed therein to load freight therein; a door opening/closing a freight doorway formed on one side of the container main body and including a first door of which one side is hinge-engaged with the container main body by a first hinge portion, and a second door of which one side is hinge-engaged with the other side of the first door by a second hinge portion; a slide rotation portion including a slide rail provided on the container main body, a movement member connected to the second door to slidably move along the slide rail, a link member connected to the movement member and an inner side surface of the second door to make the door rotate at 0 to 270 degrees around the first hinge portion, and a movement limit member connected between the movement member and one side of the link member to limit the movement of the link member; and a locking portion locking/unlocking the door with respect to the container main body. The capturing of freight can be originally prevented by a finished product itself without any separate locking device, and the merchantability and convenience in use can be improved through limiting of movement of a link member using the movement limit member to prevent the rattling of doors.

3 Claims, 8 Drawing Sheets

CONTAINER

CROSS-REFERENCE TO RELATED APPLICATION

This application is based on and claims priority from Korean Patent Application No. 10-2010-0022184, filed on Mar. 12, 2010 in the Korean Intellectual Property Office, the disclosure of which is incorporated herein in its entirety by reference.

BACKGROUND OF THE INVENTION

1. Field of the Invention

The present invention relates generally to a container, and more particularly to a container which can originally prevent capturing of freight, and improve the merchantability with providing of convenience in use through limiting of movement of a link member to prevent rattling of doors.

2. Description of the Prior Art

In general, a container is a box type freight container that is used to transport freight, efficiently or economically, and is made of diverse materials, such as wood, plywood, steel, aluminum, a light alloy, fiber reinforcement plastics (FRP), and the like. On the other hand, the container may be classified into containers for general purpose, liquid, vehicles, refrigeration, heat insulation, and the like, according to the kinds of freight being handled, and may be in diverse forms according to transport vehicles or purposes.

A container in the related art is illustrated in FIGS. 1 and 2. The container 101 in the related art includes a container main body 110 having a loading space formed therein to load freight therein, a left door 121 and a right door 122 which are rotated around a left hinge portion 151 and a right hinge portion 152 provided on the left side and the right side of the container main body 110, respectively, to open/close a freight doorway 111 formed in the rear of the container main body 110; a pair of locking rods 131 installed in a length direction of the doors 121 and 122 to be locked in and unlocked from cam keepers 136 provided at an upper end and a lower end of the container main body 110; locking portions 130 integrally provided with respective locking rods 131 and having handles 132 fixed to handle latches 134, respectively; and a plate 115 provided in a position where the left door 121 and the right door 122 are opposite to each other.

At an upper end and a lower end of the respective locking rods 131, cams 135 are formed to perform cam operations with respect to the cam keepers 136, respectively.

The plate 115 is typically called a TIR plate, and is integrally provided with the right door 122 to cover the left door 121.

To any one of the handle latches 134 provided on the right door 122, a seal 133 on which a serial number inspected at the customs is written is attached after freight is loaded in the container 101. Here, the seal 133 is provided to prevent the smuggling and robbery of the freight, and is usable only once. The container 101 is shipped in a state where the seal 133 is attached thereto.

On the other hand, in order to carry the freight out of the container 101, the seal 133 is first taken off, the right door 122 is opened, and then the left door 121 is opened. The reason why the right door 122 is first opened is that the plate 115 is provided on the right door 122 and covers the left door 121. If the respective handles 132 are rotated in both directions to open the doors 121 and 122, the respective locking rods 131 integrally provided with the handles 132 are rotated in both directions, and the cams 135 are rotated to open the doors 121 and 122 from the container main body 110 at a predetermined angle, so that an operator can easily open the doors 121 and 122.

In the container 101 in the related art, however, a capturer can easily open only the left door 121 to capture the freight in the container 101. That is, in the case of opening the right door 122, it is necessary to take off the seal 133 to leave traces of capturing, whereas in the case of opening the left door 121 having no seal attached thereto, the traces of capturing are not left even if the left door 121 is opened and then is closed, and thus it is not easy to recognize the freight captured state from the outside.

With reference to FIG. 2, a process of opening the left door 121 by a capturer to capture the freight in the container will be simply described.

First, the capturer folds the plate 115 that covers the left door 121 to facilitate the opening of the left door 121.

Then, if the capturer rotates a pair of locking rods 131 through rotation of the respective handles 132 on the side of the left door 121 in both directions (see arrows in the drawing), the cams 135 formed at the upper end and the lower end of the respective locking rods 131 are simultaneously rotated to open the left door 121 at the predetermined angle from the container main body 110, and thus the capturer can easily open the left door 121.

After the capturer opens the left door 121 and carries the freight out of the container, the capturer closes the left door through reverse processes, and then returns the folded plate 115 to its original flat state. Accordingly, the seal 133 still remains on the right door 122, and thus it is difficult to recognize that the freight in the container has been captured.

The inventor has filed a Korean Patent Application No. 10-2009-0055133 which discloses a container for originally preventing capturing of freight.

That is, the container disclosed in Korean Patent Application No. 10-2009-0055133 has a structure in which two doors are not opened or closed in both directions with respect to a container main body, but are provided in a foldable way to be slidably opened/closed in one direction with respect to the container main body. According to this container, the two doors are rotated at about 270 degrees with respect to the container main body using various kinds of link members.

However, in the case of the container as described, above, when the doors are opened or closed, the doors rattle due to the movement of the link members, and this may cause inconvenience in use and the deterioration of the merchantability.

SUMMARY OF THE INVENTION

Accordingly, the present invention has been made to solve the above-mentioned problems occurring in the prior art while advantages achieved by the prior art are maintained intact.

A subject to be achieved by the present invention is to provide a container which can originally prevent the capturing of freight, and improve the merchantability with providing of convenience in use through limiting of movement of a link member to prevent rattling of doors.

In one aspect of the present invention, there is provided a container, which includes a container main body having a loading space formed therein to load freight therein; a door opening/closing a freight doorway formed on one side of the container main body and including a first door of which one side is hinge-engaged with the container main body by a first hinge portion, and a second door of which one side is hinge-engaged with the other side of the first door by a second hinge portion; a slide rotation portion including a slide rail provided on the container main body, a movement member connected to the second door to slidably move along the slide rail, a link member connected to the movement member and an inner side surface of the second door to make the door rotate at 0 to 270 degrees around the first hinge portion, and a movement limit member connected between the movement member and one side of the link member to limit the movement of the link member; and a locking portion locking/unlocking the door with respect to the container main body.

Here, it is preferable that the movement limit member includes a support pipe integrally engaged with the movement member and having an empty space formed therein to accommodate a part of the link member; and an elastic body provided inside the support pipe to elastically pull the link member in an interior direction of the support pipe.

In this case, a guide groove may be formed on an inner surface of the support pipe along a length direction, and a guide plate may be installed in the guide groove, to which an end portion of the part of the link member that is accommodated in the support pipe is fixed to guide the movement of the link member.

It is preferable that the elastic body includes a first spring wound on an outer side of the link member and having one end that is fixed to the guide plate and the other end that is unfixed; and a second spring wound on the outer side of the link member, being apart from the first spring, and having one end that is unfixed and the other end that is fixed to the inside of the support pipe, wherein when the door is opened, the second spring is in contact with the first spring and is compressed together with the first spring.

It is preferable that the link member is of a chain type, and includes a link shaft; a plurality of upper link plates connected to an upper end of the link shaft and repeatedly arranged in upper/lower directions; and a plurality of lower link plates connected to a lower end of the link shaft and arranged in the same manner as the upper link plates.

Here, the movement member may be any one of a roller and a pipe.

As described above, according to the present invention, a container is provided, which can originally prevent the capturing of freight by a finished product itself without any separate locking device, and can improve the merchantability and convenience in use through limiting of movement of a link member using a movement limit member to prevent the rattling of doors.

BRIEF DESCRIPTION OF THE DRAWINGS

The above and other objects, features and advantages of the present invention will be more apparent from the following detailed description taken in conjunction with the accompanying drawings, in which.

DETAILED DESCRIPTION OF THE PREFERRED EMBODIMENTS

Figure 1:
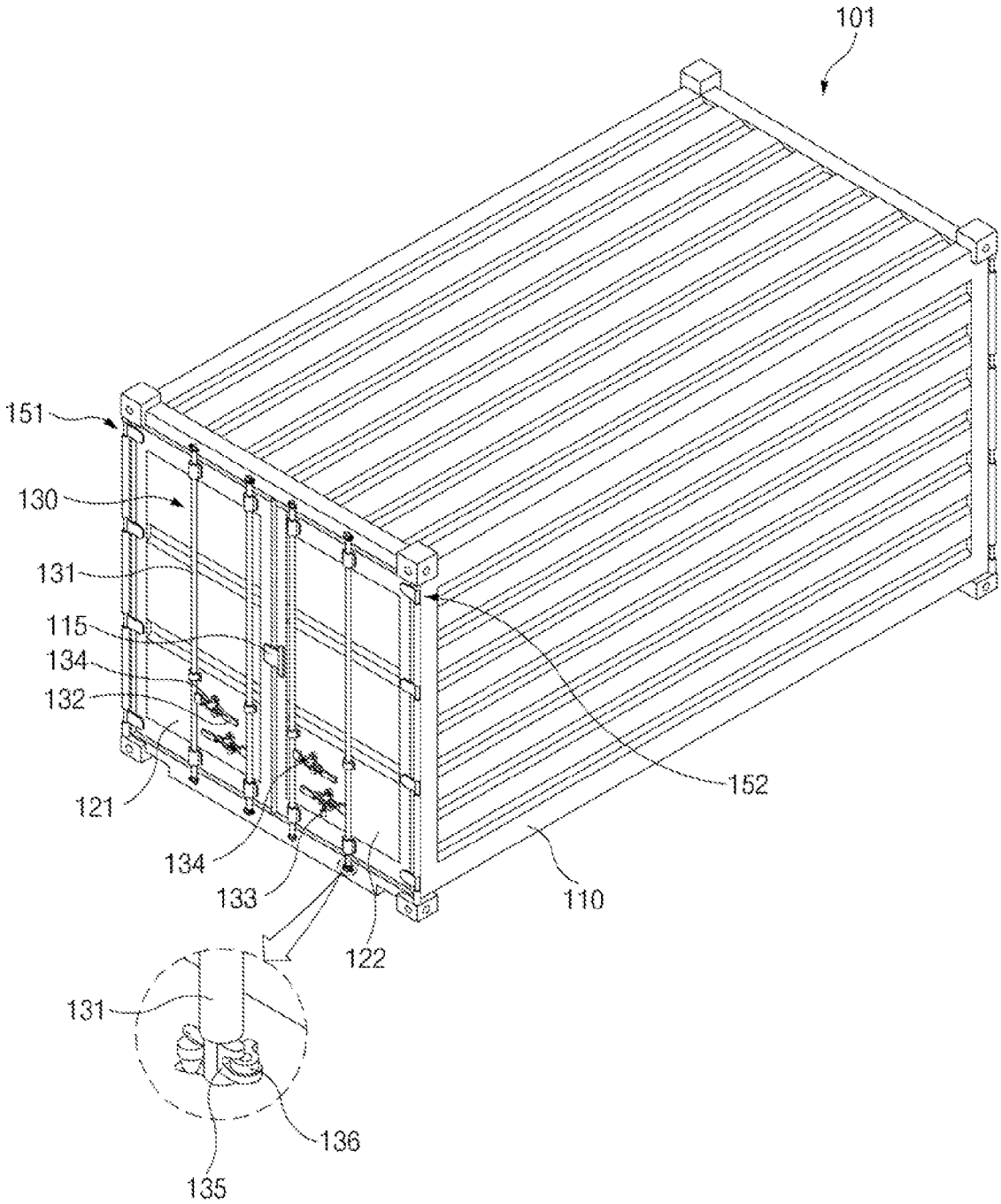
Fig.1 Prior Art
FIG. 1 is a perspective view illustrating a container in the related art.
Figure 2:
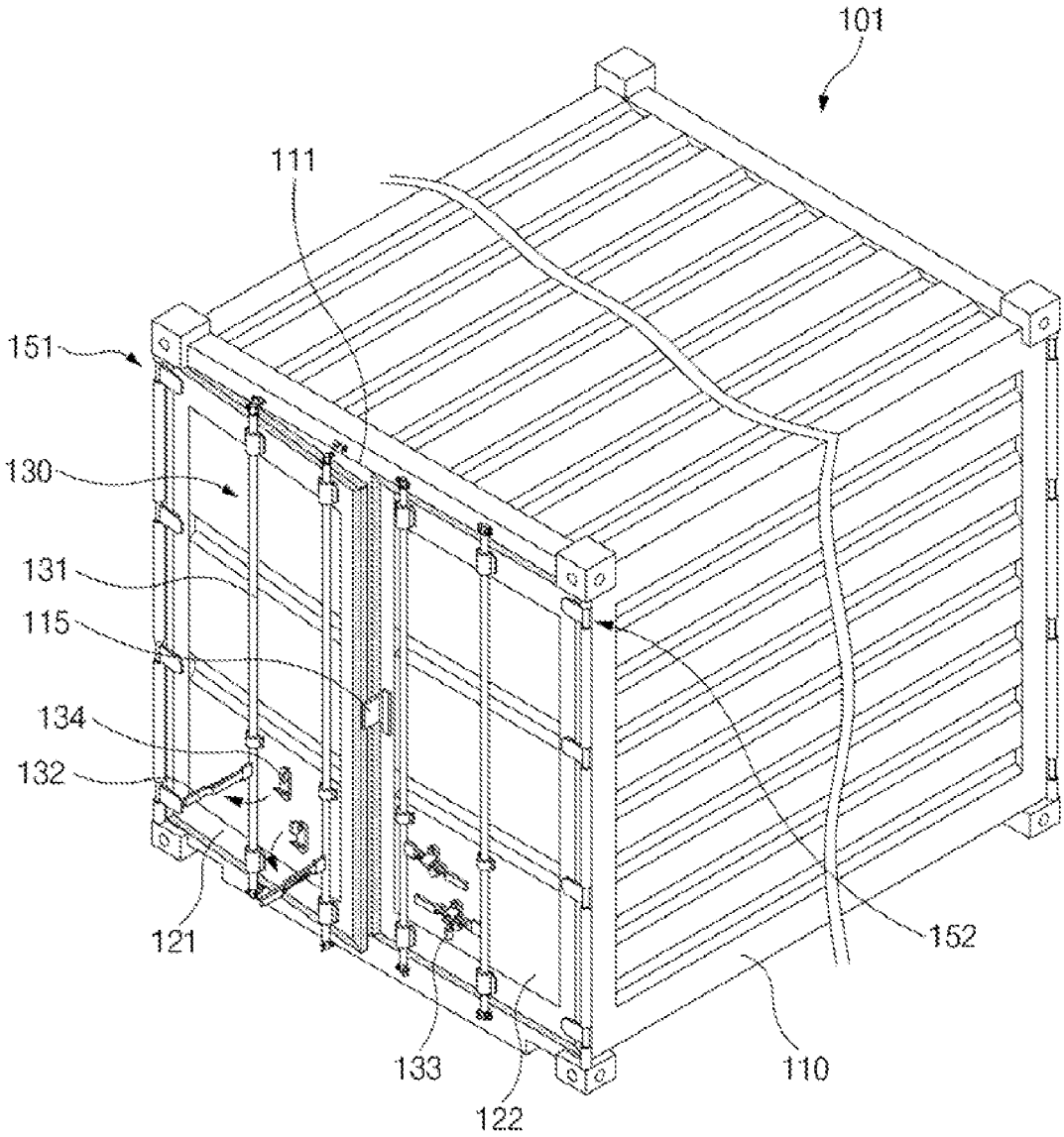
Fig.2 Prior Art
FIG. 2 is a perspective view illustrating a state where a capturer opens a door to capture freight in a container of FIG. 1.
Figure 3:
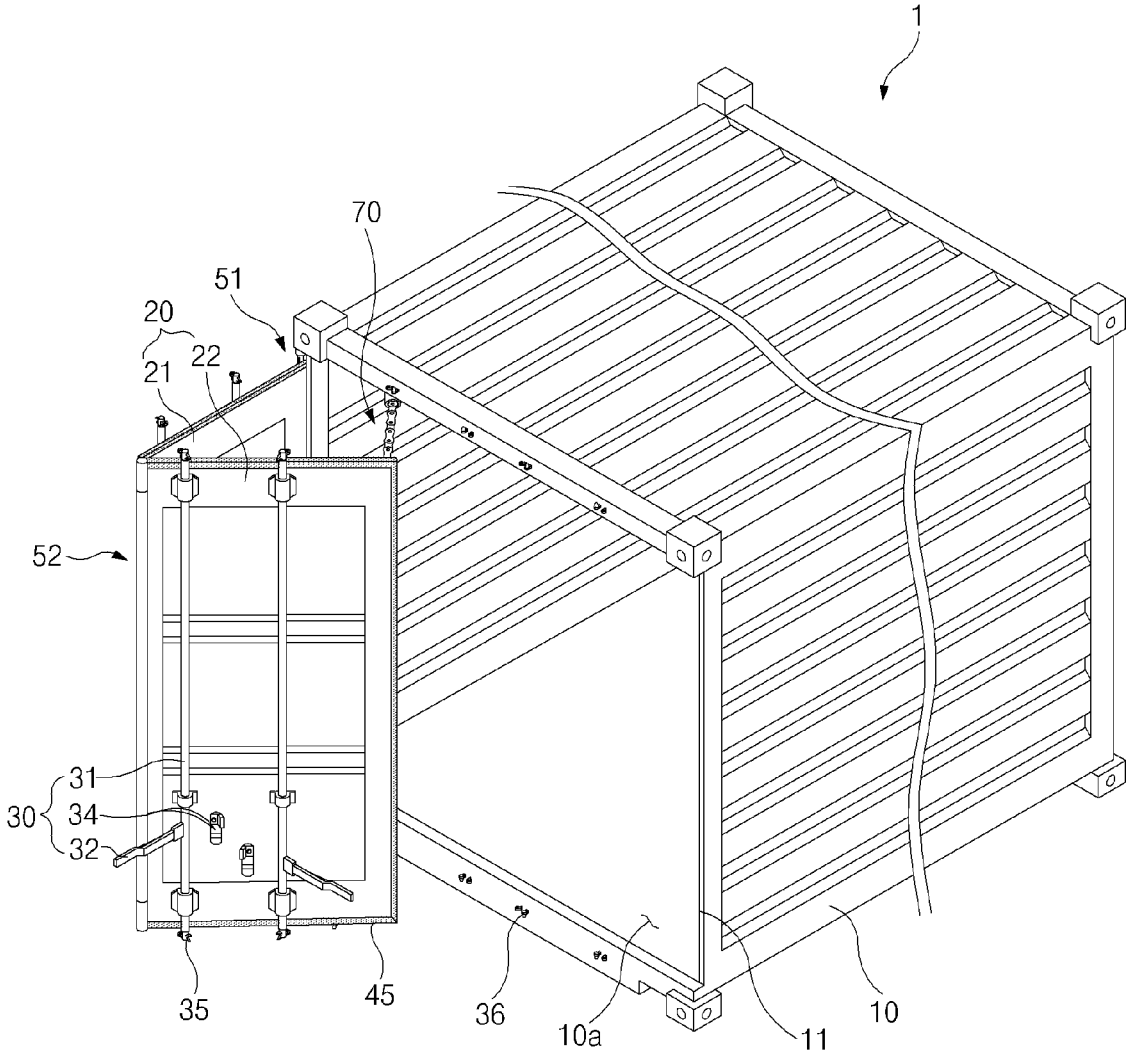
FIG. 3 is a perspective view illustrating a container according to an embodiment of the present invention.
Figure 4:
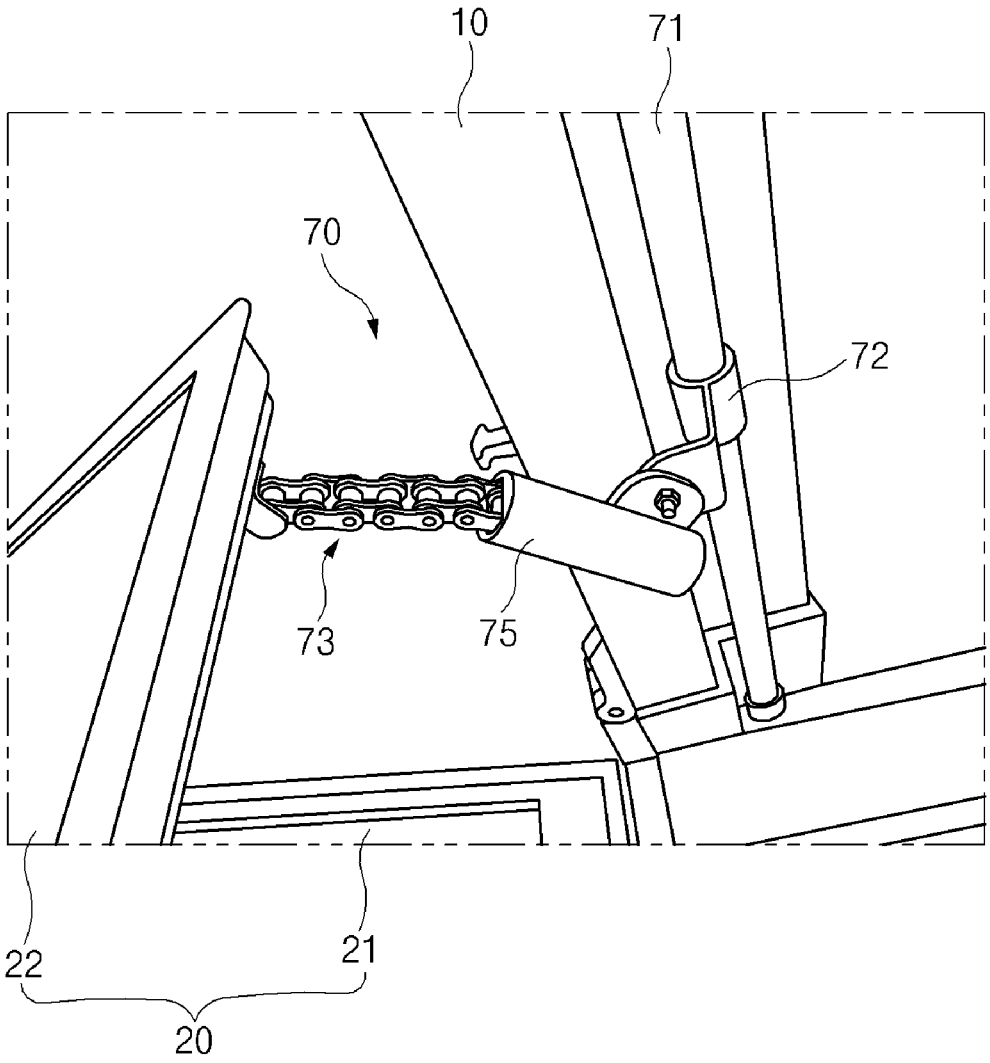
FIG. 4 is a bottom perspective view illustrating a slide rotation portion of FIG. 3.
Figure 5:
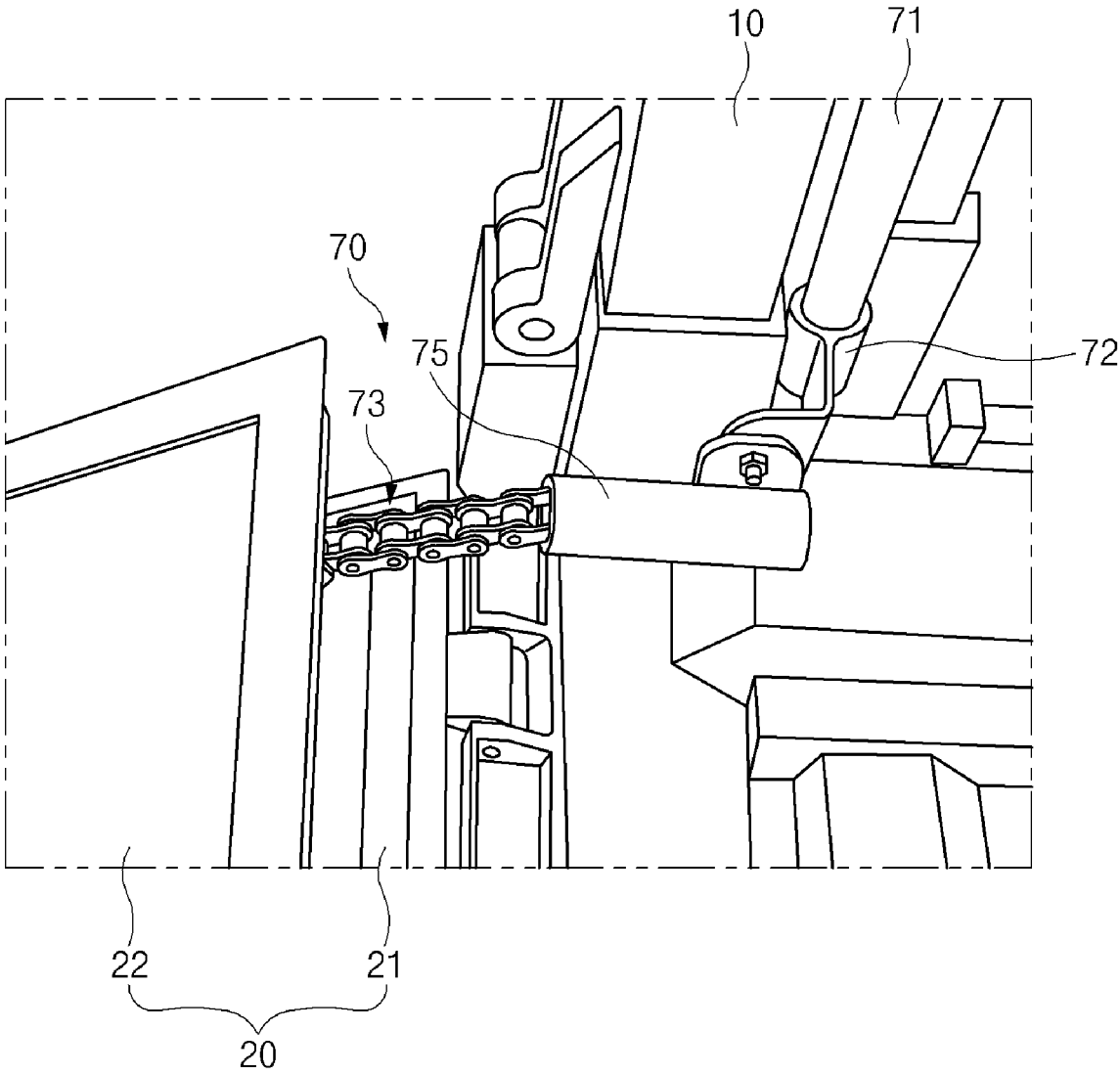
FIG. 5 is a bottom perspective view illustrating a slide rotation portion in a state where a door is further opened in comparison to the state of FIG. 4.

Hereinafter, preferred embodiments of the present invention will be described in detail with reference to the accompanying drawings. In the entire description of the present invention, the same drawing reference numerals are used for the same elements across various figures.

First, although a container according to an embodiment of the present invention is exemplified as a container for marine transport that is transported by a ship or the like, it may also be applied to a special vehicle and a freight train.

As illustrated in FIGS. 3 to 6, a container 1 includes a container main body 10 having a loading space 10*a* formed therein to load freight therein; a door 20 provided in a foldable manner to open/close a freight doorway 11 formed on one side of the container main body 10; a locking portion 30 locking/unlocking the door 20 with respect to the container main body 10; and a slide rotation portion 70 making the door 20 rotatable in one direction after the door 20 slides against the container main body 10.

The door 20 includes a first door 21 of which one side is hinge-engaged with the container main body 10 by a first hinge portion 51, and a second door 22 of which one side is hinge-engaged with the other side of the first door 21 by a second hinge portion 52. Accordingly, the second door 22 is rotated about the second hinge portion 52, and the first door 21 is rotated about the first hinge portion 51.

When the second door 22 is folded toward the side of the first door 21 around the second hinge portion 52, it slides by means of the slide rotation unit 70. In this case, since the two doors 21 and 22 can be opened at the same time, convenience in use can be provided, and the time required for loading and unloading the freight can be greatly reduced.

Here, it is preferable that a gasket 45 of a rubber material is provided on the circumference of the door 20 to seal the container main body 10 and the door 20. That is, by sealing the door 20 and the container main body 10 through the gasket 45, the percolation of water or the like into the container 1 can be prevented.

The locking portion 30 is a device for locking/unlocking the first door 21 and the second door 22 with respect to the container main body 10, and includes locking rods 31 installed in a length direction of the doors 21 and 22 and having cams 35 formed at an upper end and a lower end of the locking rods 31 to perform cam operations with respect to cam keepers 36, handles 32 integrally engaged with the locking rods 31 and held by an operator to rotate the locking rods 31, and retainer catches 34 locking/unlocking the handles 32.

The handles 32 are surrounded by the retainer catches 34 engaged with the doors 21 and 22, respectively, and the retainer catches 34 are united to the seal 133 (see FIG. 1) through the handles 32 to fix the handles 32.

Here, the seal 133 is provided to prevent the smuggling and robbery of the freight, and is usable only once. The container 1 is shipped in a state where the seal 133 is attached thereto.

In general, an operator loads the freight in the container 1, and then attaches the seal 133 on which a serial number inspected at the customs is written to the retailer catches 34.

The slide rotation portion 70 makes the door 20 slide against the container main body 10 so that the second door 22 is folded over the first door 21 around the second hinge portion 52, and makes the folded first and second doors 21 and 22 rotate at about 0 to 270 degrees in one direction around the first hinge portion 51.

Figure 7:
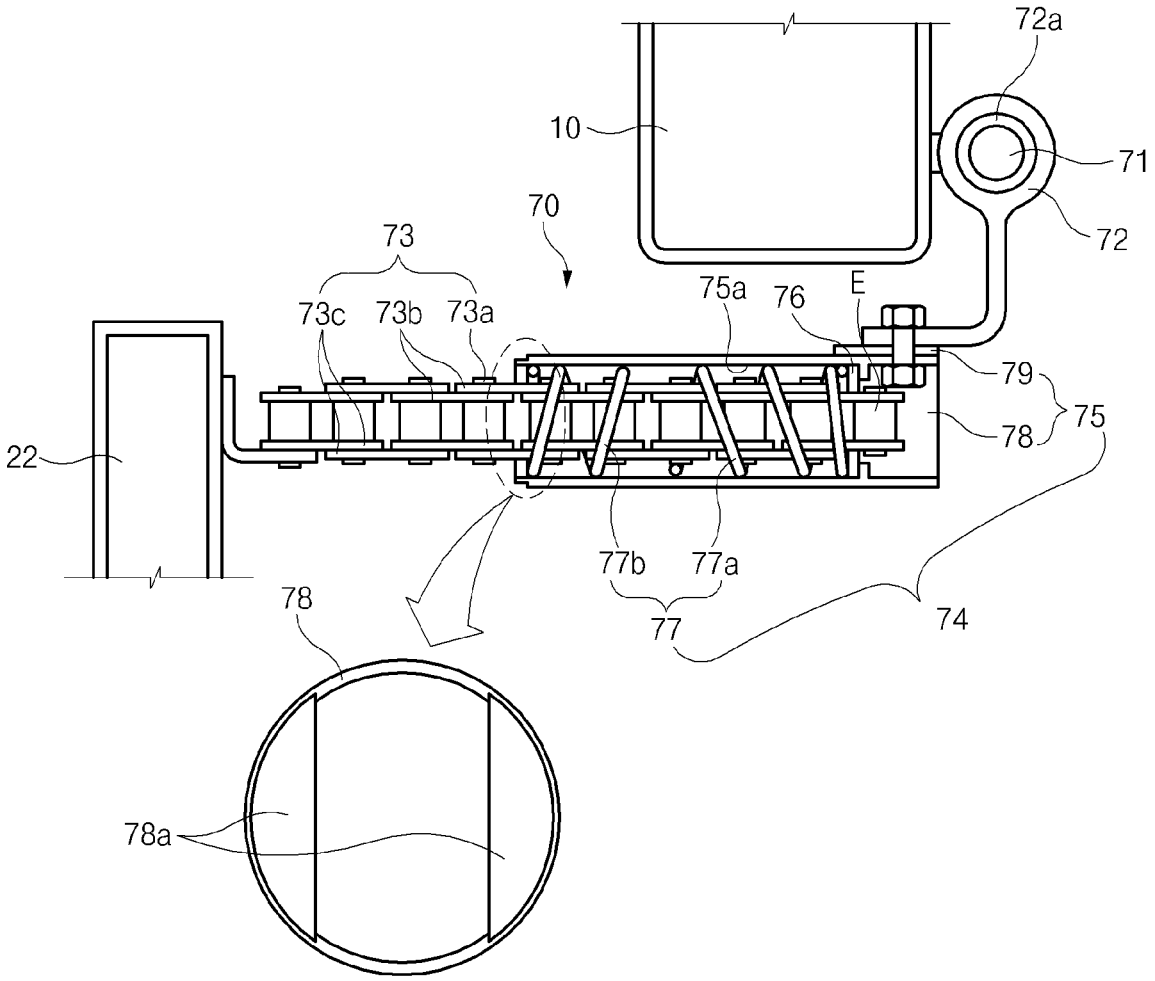
FIG. 7 is a cross-section view illustrating a slide rotation portion in a state where a door of FIG. 3 is completely closed with respect to a container main body.
Figure 8:
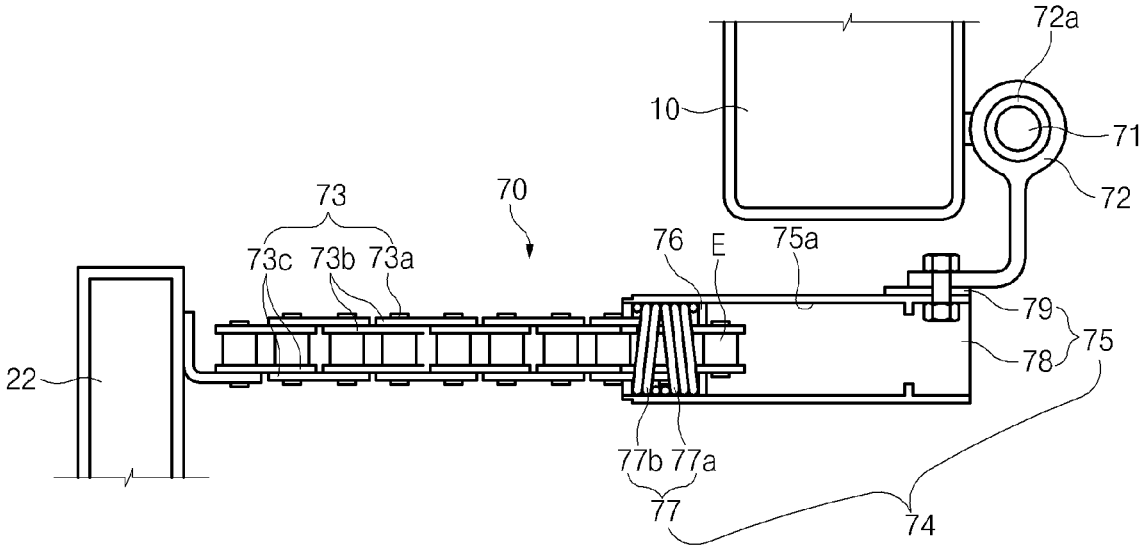
FIG. 8 is a cross-sectional, view illustrating a slide rotation portion in a state where a door of FIG. 6 is completely opened with respect to a container main body

More specifically, referring to FIGS. 7 and 8, the slide rotation portion 70 includes a slide rail 71 provided at an upper end of the container main body 10, a movement member 72 connected to the second door 22 to slidably move along the slide rail 71, a link member 73 connected to the movement member 72 and an inner side surface of the second door 22 to make the door 20 rotate at 0 to 270 degrees around the first hinge portion 51, and a movement limit member 74 connected between the movement member 72 and one side of the link member 73 to limit the movement of the link member 73.

The slide rail 71 is in the form of a rod, and is installed at an upper end of the container main body 10 in a width direction, and the movement member 72 may be a pipe that is inserted onto an outer circumference of the slide rail 71 to slidably move. In this case, on the inner surface of the movement member 72, a bearing 72*a* is installed to make the movement member 72 and the slide rail 71 in rolling contact with each other.

The link member 73 is connected to the movement member 72 via the movement limit member 74, and is of a chain type which is composed of a link shaft 73*a*, and an upper link plate 73*b* and a lower link plate 73*c* connected to an upper end and a lower end of the link shaft 73*a*, respectively.

Here, a plurality of upper link plates 73*b* are repeatedly arranged at the upper end of the link shaft 73*a* in a line, and repeatedly arranged in upper/lower directions. That is, the plurality of upper link plates 73*b* are repeatedly arranged in an up/down manner.

A plurality of lower link plates 73*c* are arranged in a line at the lower end of the of the link shaft 73*a* in the same manner as the upper link plates 73*b*.

The movement limit member 74 includes a support pipe 75 integrally hinge-engaged with the movement member 72 and having an empty space formed therein, and an elastic body 77 provided inside the support pipe 75 to elastically pull the link member 73 in an interior direction of the support pipe 75.

The support pipe 75 includes a cylindrical main body 78 of which an inlet portion is open and in which a part of the link member 73 is accommodated, and a flange 79 integrally provided with the main body 78 and hinge-engaged with the movement member 72.

In this case, a guide groove 75*a* is formed on an inner surface of the main body 78 along a length direction, and, a guide plate 76 is installed in the guide groove 75*a*, to which an end portion E of the part of the link member 73 that is accommodated in the main body 78 is fixed to guide the movement of the link member 73.

Also, a stopper 78*a* is formed in an inlet portion of the main body 78 so as to prevent the secession of the guide plate 76 that has moved up to the inlet.

In the guide plate 76, a through-hole (not illustrated) is formed, through which the upper link plate 73*b* and the lower link plate 73*c* positioned at the end portion E of the link member 73 can pass. In this case, since the link shaft 73*a* is locked in the through-hole and is supported not to secede, from the end portion E of the link member 3, the guide plate 76 slides integrally with the link member 73.

Figure 6:
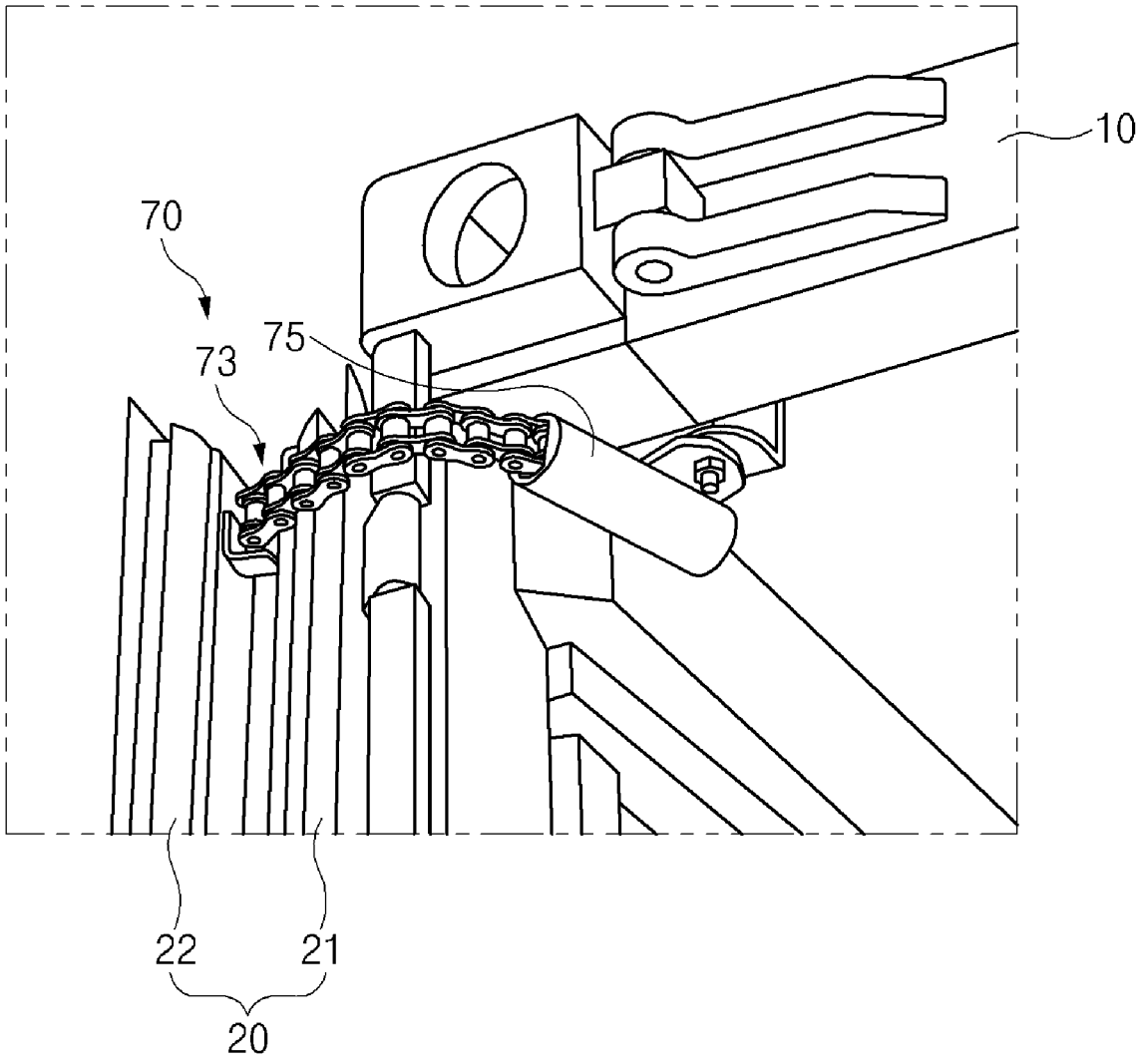
FIG. 6 is a bottom perspective view illustrating a slide rotation portion in a state where a door is completely opened (a door is rotated at about 270 degrees) in comparison to the state of FIG. 5.

That is, the positions of the guide plate 76 and the link member 73 in a state where the door 20 is not completely closed are as, shown in FIG. 7. If the door 20 is gradually opened, the link member 73 is gradually drawn toward the inlet of the main body 78, and the guide plate 76 gradually slides toward the inlet of the main body 78 together with the link member 73 along the guide groove 75*a*. Thereafter, if the door 20 is completely opened as shown in FIG. 6, the guide plate 76 and the link member 73 move up to the inlet side of the main body 78 as shown in FIG. 8, and at this time, the stopper 78*a* prevents the guide plate 76 from seceding from the main body 78.

The elastic body 77 includes two springs 77*a* and 77*b*, and serves to pull the link member 73 toward the inside of the support pipe 75.

For this, the elastic body 77 includes the first spring 77*a* wound on an outer side of the link member 73 and having one end that is fixed to the guide plate 76 and the other end that is unfixed, and the second spring 77*b* wound on the outer side of the link member 73, being apart from the first spring 77*a*, and having one end that is unfixed and the other end that is fixed to the inner side surface of the main body 78, wherein when the door 20 is opened, the second spring 77*b* is in contact with the first spring 77*a* and is compressed together with the first spring 77*a*.

Accordingly, in a state where the door 20 is closed, the first spring 77*a* and the second spring 77*b* are positioned apart from each other as shown in FIG. 7, and if the door 20 is gradually opened and the link member 73 is drawn out of the main body 78, the guide plate 76 moves together with the link member 73 as shown in FIG. 8, and the other end of the first spring 77*a* becomes in contact with one end of the second spring 77*b* so that the first spring 77*a* and the second spring 77*b* are compressed together.

That is, when the operator opens the door 20, the link member 73 is forced to the inside of the main body 78 by the elastic force of the first spring 77*a* and the second spring 77*b*, and thus the rattling of the door 20 is prevented.

On the other hand, if the operator closes the door 20, the link member 73 is pulled to the inside of the main body 78 by the restoring force of the first spring 77*a* and the second spring 77*b*, and thus the movement of the link member 73 is limited. Accordingly, a smaller force is required to close the door 20, and convenience in use can be provided.

In this embodiment of the present invention, the movement of the link member 73 is limited using two separated springs 77*a* and 77*b* instead of one spring, and in the case where the two separate springs 77*a* and 77*b* are compressed and extended, the deformation is minimized by comparison one spring, and thus the deterioration of the durability is prevented with the operability improved.

Also, in this embodiment, since the respective springs 77*a* and 77*b* are wound on the outer circumference of the link member 73, instead of fixing one end of the spring to the end of the main body 78 and fixing the other end of the spring to the end portion E of the link member 73, the length of the support pipe 75 can be reduced and thus a more compact structure can be realized.

By the above-described construction, the operational procedure of the link member 73 and the movement limit member 74 when the door 20 is opened in the container 1 according to an embodiment of the present invention will be simply described with reference to FIGS. 7 and 8.

First, the state of the link member 73 and the movement limit member 74 when the door 20 is completely closed is as shown in FIG. 7. In this case, about a half of the link member 73 is accommodated in the main body 78 of the support pipe 75.

Thereafter, if the operator gradually opens the door 20, the link member 73 is gradually drawn out of the main body 78 together with the door 20, and at this time, the guide plate 76 that is integrally fixed to the link member 73 slides in the length direction along the guide groove 75*a* of the main body 78. Accordingly, if the door 20 is completely opened at about 270 degrees as shown in FIG. 6, the link member 73 is maximally drawn out of the main body 78 as shown in FIG. 8, and the guide plate 76 is prevented from seceding from the main body 78 by the stopper 78*a*.

As described above, according to the present invention, the container can originally prevent the capturing of freight by a finished product itself even without any separate locking device, and can improve the merchantability and convenience in use through limiting of movement of a link member using a movement limit member to prevent the rattling of doors.

In the above-described embodiment, the movement member is composed of a pipe. However, the movement member may also be composed of a roller, and in this case, the slide rail may have a shape on which the roller can move.

In the above-described embodiment, the elastic member is composed of two springs. However, one spring may be provided so far as the spring is within the range that can limit the movement of the link member. Also, the elastic member may be a rubber member having elasticity instead of the spring.

In the above-described embodiment, the slide hinge portion is provided only in the container main body and the upper portion of the door. However, the slide hinge portion may also be provided even in the container main body and the lower portion of the door.

Although a preferred embodiment of the present invention has been described for illustrative purposes, those skilled in the art will appreciate that various modifications, additions and substitutions are possible, without departing from the scope and spirit of the invention as disclosed in the accompanying claims.

What is claimed is:

1. A container comprising:

a container main body having a loading space formed therein to load freight therein;

a door opening/closing a freight doorway formed on one side of the container main body and including a first door of which one side is hinge-engaged with the container main body by a first hinge portion, and a second door of which one side is hinge-engaged with the other side of the first door by a second hinge portion;

a slide rotation portion comprising:

a slide rail provided on the container main body;

a movement member connected to the second door to slidably move along the slide rail;

a link member connected to the movement member and an inner side surface of the second door to make the door rotate at 0 to 270 degrees around the first hinge portion; and a movement limit member connected between the movement member and one side of the link member to limit the movement of the link member; and a locking portion locking and unlocking the door with respect to the container main body, wherein the movement limit member comprises:

a support pipe pivotably fixed at the movement member and having an empty space formed therein to accommodate a part of the link member; and an elastic body provided inside the support pipe to elastically pull the link member in an interior direction of the support pipe, wherein a guide groove is formed on an inner surface of the support pipe along a length direction and a guide plate is installed in the guide groove to which an end portion of the part of the link member that is accommodated in the support pipe is fixed to guide the movement of the link member, and wherein the elastic body comprises:

a first spring wound on an outer side of the link member and having one end that is fixed to the guide plate and the other end that is unfixed; and a second spring wound on the outer side of the link member, being apart from the first spring, and having one end that is unfixed and the other end that is fixed to the inside of the support pipe;

wherein, when the door is opened, the second spring is in contact with the first spring and is compressed together with the first spring.

2. The container according to claim 1, wherein the link member is of a chain type, and comprises:

a link shaft;

a plurality of upper link plates connected to an upper end of the link shaft and repeatedly arranged in upper/lower directions; and a plurality of lower link plates connected to a lower end of the link shaft and arranged in the same manner as the upper link plates.

3. The container according to claim 1, wherein the movement member is any one of a roller and a pipe.

* * * * *